US006546882B1

(12) United States Patent
Gromatzky et al.

(10) Patent No.: US 6,546,882 B1
(45) Date of Patent: Apr. 15, 2003

(54) PAYMENT TERMINAL MOUNTING SYSTEM

(75) Inventors: Jonathan A. Gromatzky, Kernersville, NC (US); Joseph D. Long, Greensboro, NC (US); Phillip W. Neal, Liberty, NC (US)

(73) Assignee: Gilbarco Inc., Greensboro, NC (US)

( * ) Notice: Subject to any disclaimer, the term of this patent is extended or adjusted under 35 U.S.C. 154(b) by 0 days.

(21) Appl. No.: 09/579,754

(22) Filed: May 26, 2000

(51) Int. Cl.[7] ..... E05G 1/00
(52) U.S. Cl. ..... 109/50; 109/56; 902/30
(58) Field of Search ..... 109/50, 51, 56, 109/57, 78, 79, 22, 23, 24, 24.1; 902/30–35, 41; 52/27.5, 27–40; 40/607; 235/381; 248/186.1; 70/62

(56) References Cited

U.S. PATENT DOCUMENTS

| | | | | | |
|---|---|---|---|---|---|
| 936,527 | A | * | 10/1909 | Fisher | 109/50 X |
| 1,901,904 | A | * | 3/1933 | Ehrlich | 109/50 X |
| 2,530,543 | A | * | 11/1950 | Schneeman | 109/50 X |
| 3,534,933 | A | | 10/1970 | Zimmerman | 248/14 |
| 3,931,497 | A | | 1/1976 | Gentile et al. | 235/61.7 |
| 3,935,435 | A | | 1/1976 | Greenwood | 235/151.34 |
| 4,126,147 | A | | 11/1978 | Brisebarre et al. | 133/5 |
| 4,276,706 | A | * | 7/1981 | Scott | 40/607 |
| 4,395,626 | A | | 7/1983 | Barker et al. | 235/381 |
| 4,395,627 | A | | 7/1983 | Barker et al. | 235/381 |
| 4,408,407 | A | * | 10/1983 | Bloom et al. | 40/607 |
| 4,499,982 | A | | 2/1985 | Sugimoto et al. | 194/1 |
| 4,615,280 | A | | 10/1986 | Shoop et al. | 109/24.1 |
| 4,900,906 | A | | 2/1990 | Pusic | 235/381 |
| 4,923,157 | A | * | 5/1990 | Belamiza | 248/188.2 |
| 5,340,969 | A | * | 8/1994 | Cox | 235/381 |
| 5,664,851 | A | * | 9/1997 | Dunn | 40/607 X |
| D386,882 | S | | 11/1997 | Smith et al. | D99/28 |
| 5,797,470 | A | | 8/1998 | Bohnert et al. | 186/53 |
| 5,800,143 | A | | 9/1998 | Bravo | 405/52 |
| 5,816,174 | A | | 10/1998 | Smith et al. | 109/56 |
| 5,842,188 | A | | 11/1998 | Ramsey et al. | 705/416 |
| 5,895,457 | A | | 4/1999 | Kurowski et al. | 705/413 |
| 6,233,898 | B1 | * | 5/2000 | Burlando | 40/607 X |

FOREIGN PATENT DOCUMENTS

| | | |
|---|---|---|
| WO | WO 97/20291 | 6/1997 |
| WO | WO 97/21199 | 6/1997 |
| WO | WO 98/45820 | 10/1998 |

* cited by examiner

*Primary Examiner*—Suzanne Dino Barrett
(74) *Attorney, Agent, or Firm*—Withrow & Terranova, P.L.L.C.

(57) ABSTRACT

An automated payment system for use in a service station. The system includes at least one fuel dispenser for dispensing fuel and having a user interface for directing how payment for the fuel is to be processed. The system also includes a payment terminal positioned in proximity to the fuel dispenser for receiving the payments. The terminal has rigid outer walls forming an enclosed interior section for housing the payments. In one embodiment, the terminal has rigid outer walls forming a substantially H-shape with two indents positioned on the exterior of the payment terminal. A pair of support posts are firmly mounted within the indents for securing the payment terminal in position. Mounting mechanisms may attach the payment terminal to the support post and be positioned such that they are contained within the terminal and post to restrict access.

20 Claims, 4 Drawing Sheets

PAYMENT TERMINAL MOUNTING SYSTEM

FIELD OF THE INVENTION

The present invention is directed to a system for mounting a payment terminal and, more particularly, to mounting the payment terminal against a support post to deter theft.

BACKGROUND OF THE INVENTION

Payment terminals are becoming more commonplace as an interface for users to purchase goods and services and accept a variety of payments such as cash, credit a card, debit card, and others. Consumers usually appreciate the payment terminals because they are conveniently located and can usually process a transaction quicker than a human attendant. One example of a payment terminal commonly seen in everyday life are those positioned at gas service stations which enable the user to pay for the fuel at the fuel dispenser without having to go into the service station.

Payment terminals are a common target for thieves because they often contain large amounts of cash. Additionally, payment terminals may be positioned in isolated areas that either have no human attendants monitoring their security, or only a limited number of attendants monitoring a plethora of payment terminals. Thieves may tip the payment terminals over thereby gaining access to the interior where the cash is stored. Alternatively, thieves may remove the entire terminal from the premises at which time they can use tools or other devices to overcome the security measures to access the cash.

To prevent the likelihood of theft, payment terminals are often secured to support posts or other like structures. These support posts may be part of a building or securely mounted within the ground such that they can not be removed. A difficulty occurs in attaching the payment terminal to the support post in a theft-proof manner. If the mounting hardware connecting the two elements is exposed, thieves may cut the hardware then simply remove the payment terminal with the stored money.

Previous patents have dealt with overcoming the problem of exposed mounting hardware such as U.S. Pat. No. 5,816,174 to Smith et al. that discloses two substantially L-shaped payment terminals aligned such that they completely surround the exterior of the supporting post. However, this requires that the terminal device be comprised of two separate pieces that fit together which may be prohibitively expensive.

Thus, there remains a need for a payment terminal that is securely positioned against at least one support post, either by the positioning of the posts relative to the terminal, or by the use of a mounting mechanism.

SUMMARY OF THE INVENTION

The present invention provides for mounting a payment terminal such that the likelihood of theft is greatly diminished. In one embodiment, the payment terminal includes a housing forming an interior section containing a payment container and having an access port for accessing the interior section. A door is positioned within the opening and is selectively positionable between a closed orientation in which the interior section is inaccessible, and an open orientation in which the interior section is accessible. At least one support post is positioned against an exterior of the housing, and a mounting mechanism connects the housing and the support post. The mounting mechanism is positioned within the housing interior section and is accessible when the door is positioned in the open orientation. The mounting mechanism is not exposed on the exterior of the payment terminal or the support post, therefore, it cannot be damaged by thieves resulting in the entire terminal or the stored money being stolen. Preferably, the housing includes at least one arm section positioned about the support post to further protect the mounting mechanism.

In another embodiment, first and second support posts are positioned against opposing terminal outer walls for securing placement of the terminal. The terminal is contained between the posts and is constructed of a rigid material thereby preventing the terminal from being pushed or pulled away from the posts. Specific embodiments include the terminal having a substantially H-shape, and a substantially C-shape formation. Within the two post embodiment, a mounting mechanism may connect the terminal to at least one of the posts. Additionally, mounting mechanisms may extend between the terminal and each of the posts.

The present invention is suitable for use in numerous settings, including a service station environment. The station includes at least one fuel dispenser for dispensing fuel, and includes a user interface for directing payment of the fuel. A payment terminal is positioned in proximity to the fuel dispenser for receiving the payment. The terminal includes a payment input device for receiving payment from a customer and storing the payment. The payment terminal is positioned between support posts to again deter theft. The support posts may be specifically mounted for the payment terminal, or may have other functions such as for supporting an awning over the fuel dispensers.

The invention also includes a method of installing a payment terminal to deter theft. A first support post is permanently mounted in a secure manner. Afterwards, a first rigid exterior wall of a payment terminal is positioned against the support post. A second support post is securely mounted against a second rigid exterior wall of the payment terminal. The post positioning prevents the terminal from being moved.

DETAILED DESCRIPTION OF THE INVENTION

Figure 1:
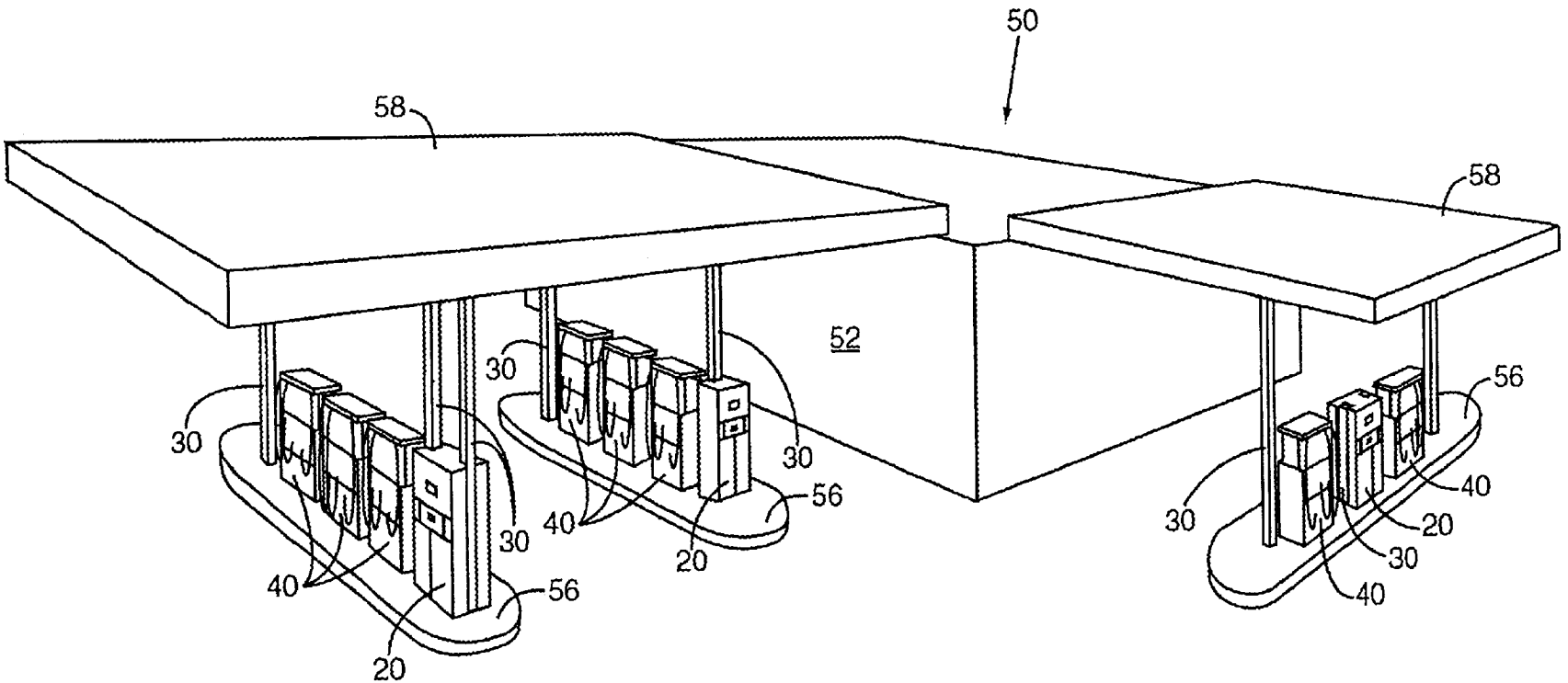
FIG. 1 is a perspective view of a gasoline service station having a number of payment terminals attached to support posts in accordance with the present invention.

FIG. 1 illustrates a service station 50 that utilizes the convenience and ease of use of the payment terminals 20. The service station 50 normally includes an interior retail area 52 for selling food, drinks, newspapers, and various other items for which the passing motorists may have a need. Fuel dispensers 40 are positioned on fuel islands 56 spaced about the service station 50 and forming lanes for motorists to park their vehicles during the fueling process. Payment terminals 20 are positioned throughout the service station 50 at convenient locations for use by motorists in paying for the fuel. As illustrated in FIG. 1, each island 56 includes a separate payment terminal 20 that is preferably positioned under awnings 58 to protect the terminals and motorists from the weather.

Figure 2:
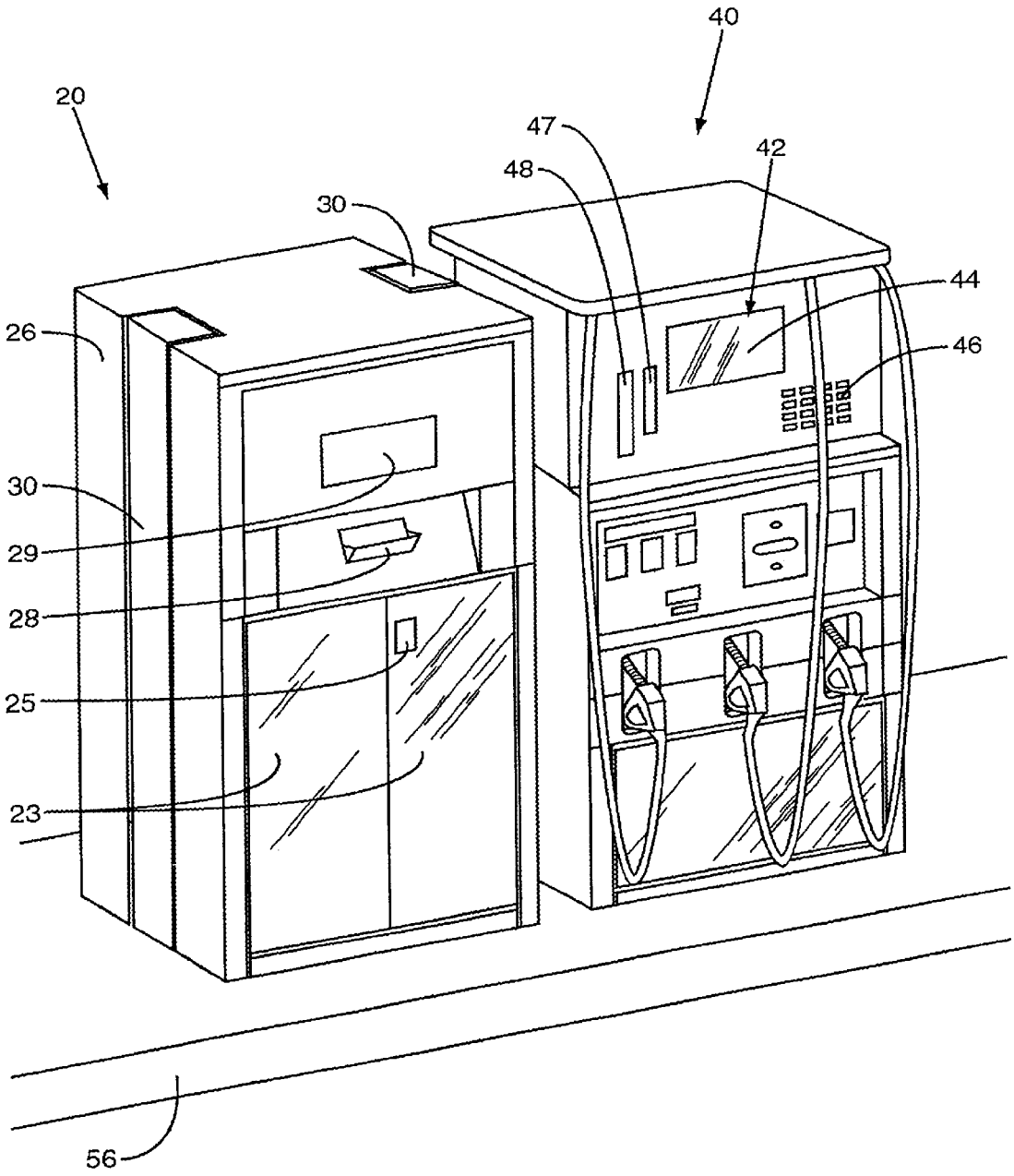
FIG. 2 is a perspective view of a payment terminal positioned between to support posts and adjacent to a fuel dispenser.

FIG. 2 illustrates one embodiment of a payment terminal 20 positioned between two support posts 30 and in proximity to the fuel dispenser 40. Each fuel dispenser 40 has two opposite sides for fueling vehicles, and the payment terminal 20 is comprised of one housing with two opposite sides to service each side of the fuel dispenser 40.

The payment terminal 20 includes rigid outer walls 26 that form an enclosed interior section. The outer walls 26 may form a variety of shapes including substantially rectangular, C-shape, H-shaped, and various others. A payment acceptor 29 is positioned on at least one outer wall 26 for receiving payment for a fueling purchase, and a change dispenser 28 is also positioned on at least one outer wall for dispensing any refund due the user. Both the change dispenser 28 and payment acceptor 29 may utilize a common access port, or they may include two separate ports as illustrated in FIG. 2.

Other embodiments can be implemented for configuring terminal devices 20 to fuel dispensers 40. For instance, a terminal device 20 can be configured to handle transactions for one two-sided fuel dispenser 40. A terminal device 20 can also be configured to handle transactions for a multitude of fuel dispensers 40 or even all of the fuel dispenser 40 at the entire service station 50. If a terminal device 20 is configured to handle transactions with fuel dispensers 40 for any of these configurations, the terminal device 20 must have the capability of communicating with the fuel dispensers 40 to match the correct transaction to the correct fuel dispenser 40 and additionally may require additional hardware in the terminal device 20 such as a display for the customer. An input device may also be additionally needed for the customer to choose the fuel dispenser 40 that he or she wishes to provide payment for or to correlate a particular fuel dispenser 40 transaction to the terminal device 20 to give the customer the correct change.

Preferably, the terminal device 20 includes a payment acceptor 29 and a change dispenser 28. The payment acceptor 29 is capable of receiving paper currency, such as $1, $5, $10, and $20 bills, or coins, or both.

The change dispenser 28 only dispenses coins in one embodiment, however, it also may be configured to dispense both coins and paper currency. Other payment receiving means may also be positioned on the terminal 20, such as a debit and credit card reader. The term "payment" in the present invention should be understood to mean these various type of transactions that include cash (paper and coin), debit and credit cards, and other types of electronic communication payment mediums such as transponders and smart cards. Payment terminals for fuel dispensers 40 and service stations 50 are well known in the art such as those disclosed in U.S. Pat. Nos. 5,842,188; 5,816,174; 5,797,470; 4,395,626; and 5,895,457, each of which is incorporated by reference in their entirety.

The fuel dispenser 40 illustrated in FIG. 2 processes the fueling transaction. The dispenser 40 includes user interface 42 having a display screen 44 and input keys 46. A magnetic strip reader 48 for credit and debit card purchases may also be included on the fuel dispenser. Preferably, the fuel dispenser 40 is capable of receiving credit and debit card transactions, as the payment terminal 20 is configured for cash transactions. A receipt output 47 dispenses a paper receipt for the user's records for either credit/debit, or cash transactions.

The payment terminal 20 and fuel dispenser 40 may be configured to handle a single transaction, or multiple transactions at a single time. Concurrent users may be accommodated by having more than one user interface and payment acceptor spaced about the exterior of the terminal 20 and dispenser 40. By way of example, the payment terminal 20 and fuel dispensers 40 illustrated on island A of FIG. 1 may include user interface's and payment receipt devices on two separate sides such that users on each side of the island may concurrently process a fueling transaction.

The payment terminals 20 and fuel dispenser 50 are linked together to allow for processing the fueling transactions. The link may take the form of a physical connection such as a hardwire extending between the devices, or may include a radio frequency transceiver. This connection provides for the two devices to handle a single fueling transaction. By way of example, a user may follow the prompts of the display screen 44 and desire to input a cash transaction. The display screen 44 may then prompt the user to insert the payment into the payment acceptor 29. Once the currency has been input by the user, the payment acceptor 29 verifies the amount input and signals the fuel dispenser 40 to proceed with the transaction for the given amount. Preferably, the payment terminal 20 and fuel dispenser 40 are configured such that a payment must be received prior to dispensing fuel.

An access port is positioned within the outer walls 26 of the terminal device 20 for gaining access to the interior of the payment terminal 20. One embodiment features doors 23 extending across the access port to access the interior. During normal operation, the doors 23 are securely fastened and locked in a closed orientation as illustrated in FIG. 2 to prevent theft of any payments stored within the interior. A lock 25 requiring a key or combination prevents the doors 23 from becoming inadvertently opened. Doors 23 may have a variety of sizes and shapes, depending upon the specific requirements and shape of the access port.

Figure 3:
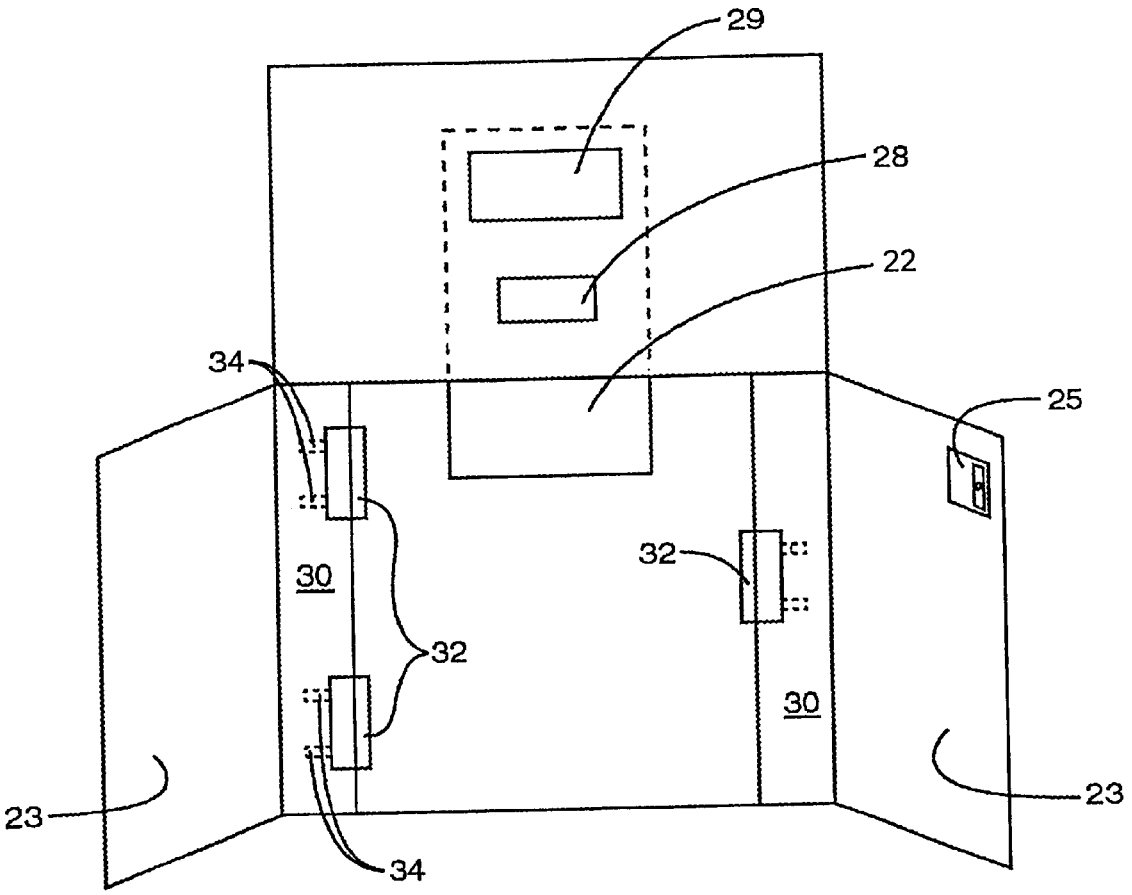
FIG. 3 is a side view of the payment terminal of FIG. 2 having the doors open revealing the mounting mechanisms attached to the support posts.

FIG. 3 illustrates the payment terminal 20 with the doors 23 in an open orientation. A payment container 22 is positioned adjacent to the cash acceptor 29 and cash dispenser 28 for storing the paper and coin currency that is housed within the terminal 20. Payment container 22 may include additional security measures such as locks to further prevent theft.

Mounting mechanisms 32 may be positioned within the interior of the payment terminal 20. The preferred embodiment includes two mounting mechanisms 32. The mounting mechanisms 32 are attached to the interior of the payment terminal outer wall 21 and include mounting hardware 34 that extends into the support posts 30. A variety of mounting techniques are available for permanently attaching payment terminal 20 to support posts 30 as will be understood by one skilled in the art and are to be understood to be included within this invention. One example includes a metal plate mounted to the interior outer wall with bolts extending through the steel plate into the support posts 30. Another example includes keyhole openings within the mounting mechanisms 32 through which mounting hardware 34 such as bolts or other like fasteners are mounted.

It is important that the mounting mechanisms 32 do not extend to the exterior of the payment terminal 20 or support post 30. Preferably, the only access to the mounting mechanism 32 is through the interior of the payment terminal, such as by unlocking the doors 23 so that persons attempting to tamper or remove the terminal device 20 cannot get clear access to the mounting mechanisms 32 to detach then from the support posts 30. Alternatively, the payment terminal 20 may be positioned between adjacent support posts 30 such that no connection is required as will be explained in more detail below.

Figure 4:
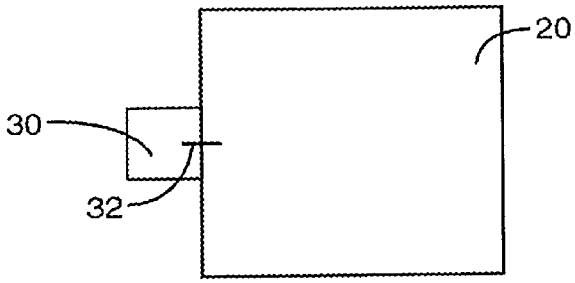
FIG. 4 is a top view of another manner of mounting the payment terminal to the support post.

FIG. 4 illustrates a top view of a payment terminal 20 positioned adjacent to support post 30. Preferably, the support post 30 includes at least one edge that is substantially linear to allow for a more flush fit against the surface of the payment terminal 20. However, various dimensions and sizes of support posts 30 may be accepted by the present invention. As illustrated in FIGS. 4, a circular support post 30 is attached to the payment terminal 20 via mounting mechanism 32.

Figure 5:
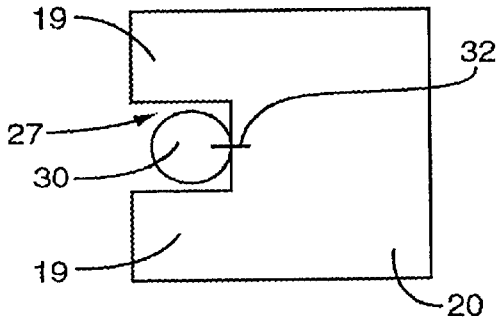
FIG. 5 is a top view of another mounting embodiment.

The orientation of the payment terminal 20 may be such that it further helps to protect and isolate the mounting mechanism 32 to prevent persons from tampering with and gaining access to it. By way of example, the payment terminal 20 in FIG. 5 is substantially "C" shaped such that the two arm sections 19 form an indent 27 to partially surround the support post 30 making it more difficult for a thief to gain access to the mounting mechanism 32. Likewise, as illustrated best in FIG. 2, the payment terminal 20 is substantially "H" shaped having two indents 27 to again further protect the mounting mechanism 32. Preferably, the mounting mechanism 32 is positioned away from the exposed exterior of the support post 30.

Various other alignments of the payment terminal 20 with respect to the support post 30 are contemplated by this invention. As illustrated in FIG. 4, a substantially rectangular payment terminal 20 is positioned adjacent to support post 30 once again with locking mechanism 32 internally located within the post 30 and payment terminal 20.

The support posts 30 may have a variety of heights depending upon their usage. As illustrated in FIG. 1, support posts 30 function to both support the payment terminal and are part of the awning structure 58. Alternatively, the support posts 30 may extend to be flush with a top edge of the payment terminal 20, or may have a height less than the terminal.

Figure 6:
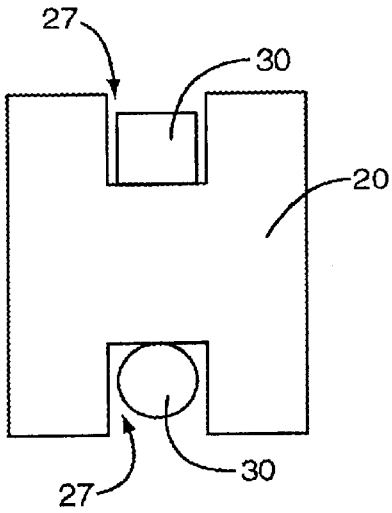
FIG. 6 is a top view of a payment terminal mounted between two support posts without mounting mechanisms.

FIG. 6 illustrates a payment terminal 20 configuration in which no mounting mechanisms are required. The two support posts 30 are positioned on opposing sides of the terminal 20 such that each acts as a block to prevent the terminal device 20 from being separated. The payment terminal may be permanently attached to the ground, or a roof or other mechanism may prevent the terminal 20 from being lifted over the support posts 30. As illustrating in FIG. 6, the support posts 30 are positioned on directly opposite sides of the payment terminal 20. However, other configurations of support posts 30 positioning relative to the payment terminal 20 are available such that it is not necessary for a mounting mechanism 32 to prevent the payment terminal from being separated.

Installation of the payment terminal 20 within the service station 50 is accomplished by securely mounting a support post 30 proximate to a fuel dispenser. In one embodiment, one end of the support post 30 is a buried within the ground and fastened by concrete, or the like. One side of the payment terminal 20 is placed against the support post 30. A mounting mechanism 30 is necessary to connect the terminal 20 and post 30 when only a single support post is used. In another embodiment, a second support post 30 may be mounted on an opposing payment terminal outer wall. Positioning two separate support posts 30 on opposing sides provides for the payment terminal 20 to be maintained in position without the use of mounting mechanisms 30. The proximity of the support posts 30 to the rigid outer walls 21 prevents movement of the terminal 20.

The present invention may be carried out in other specific ways than those herein set forth without departing from the spirit and essential characteristics of the invention. The present application has discussed the invention in terms of a fueling service station. However, one skilled in the art will understand that the present invention may also have applications within various other environments. The present embodiments are, therefore, to be considered in all respects as illustrative and not restrictive, and all changes coming within the meaning and equivalency range of the appended claims are intended to be embraced therein.

What is claimed is:

1. A payment terminal comprising:

a housing forming a single interior section containing a payment container, said housing comprising an access port for accessing said single interior section;

a door positioned within said opening and being selectively positionable between a closed orientation in which said single interior section is inaccessible, and an open orientation in which said single interior section is accessible;

at least one support post positioned against an exterior of said housing; and a mounting mechanism for connecting said housing and said support post, said mounting mechanism positioned within said housing interior section and extending into said support post such that said mounting mechanism is not accessible from the exterior of said housing, said mounting mechanism being accessible when said door is positioned in said open position.

2. The terminal of claim 1, wherein said housing includes at least one arm section positioned about said support post.

3. The terminal of claim 2, wherein said housing is substantially H-shaped.

4. The terminal of claim 1, wherein said housing includes a cash acceptor and a cash dispenser operatively connected to said payment container for receiving and dispensing payments.

5. An automated payment system comprising:

a terminal for receiving and dispensing payments, said terminal comprising a plurality of rigid outer walls forming a single interior section for storing the payments; and first and second support posts positioned against opposing terminal outer walls for securing placement of said terminal.

6. The system of claim 5, wherein said support posts extend above the height of said outer walls.

7. The system of claim 5, wherein said support posts extend a distance less than the height of said outer walls.

8. The system of claim 7, further including a top section mounted on said terminal for maintaining said terminal positioned against said support posts.

9. The system of claim 5, wherein said outer walls form at least one arm that extends around a portion of at least one of said support posts.

10. The system of claim 9, wherein said outer walls are positioned in a substantially H-shaped formation.

11. The system of claim 9, wherein said outer walls are positioned in a substantially C-shaped formation.

12. The system of claim 5, further including a mounting mechanism extending between said terminal and one of said support posts for securing placement of said terminal.

13. The system of claim 12, wherein said mounting mechanism is positioned within an interior section of said terminal and said support post.

14. The system of claim 5, wherein said terminal device is connected to said first support post only.

15. The system of claim 5, wherein said terminal device is connected to said first and second support posts.

16. A method of installing a payment terminal to deter theft, the method comprising the steps of:

permanently mounting a first support post;

positioning a first rigid exterior wall of a payment terminal comprising a single interior chamber against the support post; and permanently mounting a second support post against a second rigid exterior wall of the payment terminal, wherein one of the first and second support posts is positioned within an indent formed by the payment terminal exterior wall.

17. The method of claim 16, further including positioning a mounting mechanism between one of the first and second support posts and the payment terminal exterior wall.

18. The method of claim 16, wherein both first and second support posts are positioned within indents formed by the payment terminal exterior wall.

19. The method of claim 18, wherein the payment terminal is substantially H-shaped.

20. The method of claim 16, further including positioning the second support post on an opposing outer wall from the first support post.

* * * * *